United States Patent [19]

Matsubara

[11] 4,128,983

[45] Dec. 12, 1978

[54] PANEL CONNECTOR ASSEMBLY

[75] Inventor: Isamu Matsubara, Nyuzen, Japan

[73] Assignee: Yoshida Kogyo K.K., Tokyo, Japan

[21] Appl. No.: 844,910

[22] Filed: Oct. 25, 1977

[30] Foreign Application Priority Data

Oct. 30, 1976 [JP] Japan ..... 51-146376[U]

[51] Int. Cl.[2] ..... E04C 3/06

[52] U.S. Cl. ..... 52/731; 52/461; 52/238; 52/403

[58] Field of Search ..... 52/461–465, 52/403, 582, 584, 238, 241, 395, 731; 42/396; 403/406, 407

[56] References Cited

U.S. PATENT DOCUMENTS

| | | | |
|---|---|---|---|
| 3,057,444 | 10/1962 | Walberg | 52/461 |
| 3,512,819 | 5/1970 | Morgan et al. | 52/461 |

FOREIGN PATENT DOCUMENTS

| | | | |
|---|---|---|---|
| 228144 | 5/1960 | Australia | 52/461 |
| 1350917 | 4/1974 | United Kingdom | 52/403 |

*Primary Examiner*—James L. Ridgill, Jr.

*Attorney, Agent, or Firm*—Hill, Gross, Simpson, Van Santen, Steadman, Chiara & Simpson

[57] ABSTRACT

A connector assembly for connecting two panels edge to edge with a joint opening therebetween, each of the panels having a groove extending longitudinally along such edge thereof. The connector assembly comprises: a pair of oppositely disposed, elongated first and second members having first and second plug means adapted to be secured to the panels along their respective panel grooves; a pair of opposed first and second front arm means adapted to be disposed adjacent to one face of the joint opening, and carried by the first and second members along their respective front longitudinal edges; a pair of opposed first and second rear arm means adapted to be disposed adjacent to the opposite face of the joint opening, and carried by the first and second members along their respective rear longitudinal edges; and a pair of elongated front and rear third members for covering the joint opening on opposite faces, and holding the pair of front arm means and the pair of rear arm means, respectively, whereby the first and second members are secured to each other.

6 Claims, 3 Drawing Figures

PANEL CONNECTOR ASSEMBLY

BACKGROUND OF THE INVENTION

Field of the Invention

This invention relates to a connector assembly for connecting adjacent curtain wall units or panels edge to edge to assemble a curtain wall, a partition or the like.

SUMMARY OF THE INVENTION

A primary object of the present invention is to provide a connector assembly which facilitates easy assembling of a curtain wall or a partition construction.

Another object of the present invention is to provide a connector assembly which, as attached between curtain wall components or panels, has sufficient structural strength to transmit forces, from either joined part to the other, either edgewise of facewise.

Still another object of the present invention is to provide a connector assembly which is constructed to enable removal of any wall component or panel for replacement without the necessity of disturbing a number of adjacent wall components or panels.

A further object of the present invention is to provide a connector assembly which permits wide latitude in the order of arrangement or installation of wall components or panels.

A still further object of the present invention is to provide a connector assembly including sealing means which, in addition to its ordinary purposes such as providing airtightness and/or sound insulation, serves as an absorber for dimensional errors of factory-made wall components or panels, thereby requiring no high degree of dimensional precision of the wall units to be joined.

Accordingly, a connector assembly of the present invention comprises a pair of oppositely disposed elongated first and second members having, respectively, first and second plug means adapted to be fixed to adjacent panels along their respective panel grooves. A pair of opposed front arm means are adapted to be disposed adjacent to one face of the joint opening, and are carried by the first and second members along their respective front longitudinal edges; a pair of opposed rear arm means are adapted to be disposed adjacent to the opposite face of the joint opening, and are carried by the first and second member along their respective rear longitudinal edges. A pair of elongated front and rear third members are adapted to cover the joint opening on opposite faces, and hold the pair of front arm means and the pair of rear arm means, respectively.

Additional objects as well as features and advantages of the present invention will become evident from the description set forth hereinafter when considered in conjunction with the accompanying drawing in which preferred structural embodiments incorporating the principles of the present invention are shown by way of illustrative example.

DESCRIPTION OF THE PREFERRED EMBODIMENTS

Figure 1:
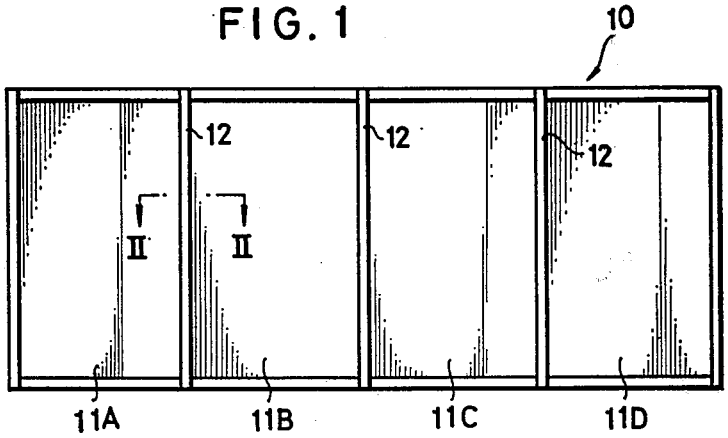
FIG. 1 is a front elevational view of a partition assembled by a plurality of connector assemblies each embodying the present invention.

In the accompanying drawing, FIG. 1 illustrates a partition 10 in which partition components or panels 11A, 11B, 11C and 11D are connected edge to edge by attaching connector assemblies 12 between adjacent panels. The panels are made of a substantially rigid material, such as wood, metal, synthetic resin and the like.

Figure 2:
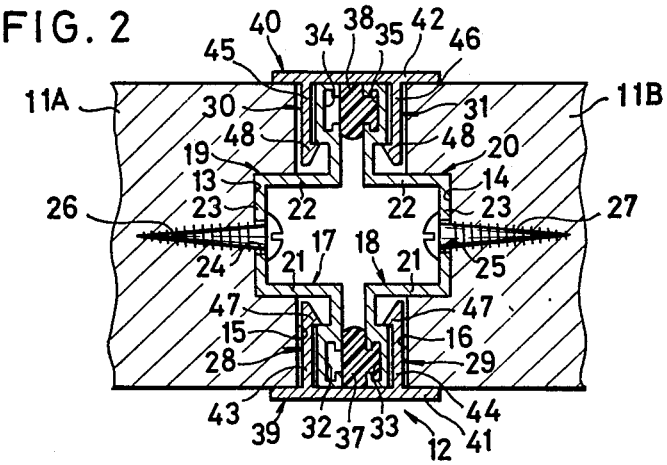
FIG. 2 is a fragmentary, enlarged horizontal cross-sectional view taken along line II—II of FIG. 1, showing one of the connector assemblies.

As shown in FIG. 2, the two adjacent panels 11A, 11B are arranged edge to edge with a space or joint opening therebetween, and each have a groove 13, 14 extending longitudinally along and centrally of a panel edge 15, 16.

Oppositely disposed within the joint opening between the adjacent panels 11A, 11B are a pair of elongated first and second members 17, 18 which are made of a relatively rigid but slightly resilient material, such as extruded aluminum. The first and second members 17, 18 are provided with a pair of first and second plug projections 19, 20, respectively. Each of the first and second plug projections 19, 20 has a substantially U-shaped transverse cross section defined by a pair of spaced side walls 21, 22 projecting perpendicularly from one side of one of the first and second members 17, 18 and terminating in an end wall 23 extending between the side walls 21, 22, such two U-shapes opening toward each other.

Each of such end walls 23, 23 has a plurality of holes 24, 25 (only one of which is illustrated on each side for clarity) through which a corresponding number of fastening screws 26, 27 (only one of which is also illustrated on each side for clarity) loosely extend into one of the panels 11A, 11b. Thus, the first and second members 17, 18 are secured to the respective panels, the first and second plug projections 19, 20 being received in the respective panel grooves 13, 14.

Disposed adjacent to one face of the joint opening are a pair of first and second front arm projections 28, 29 spaced apart from each other and carried by the first and second members 17, 18 along their respective front longitudinal edges. In turn, disposed adjacent to the opposite face of the joint opening are a pair of first and second rear arm projections 30, 31 spaced apart from each other and carried by the first and second members 17, 18 along their respective rear longitudinal edges. Each of such four arm projections 28, 29 30, 31 has a substantially C-shaped transverse cross section so as to provide a flanged recess 32, 33, 34, 35.

For airtightness and sound insulation purposes, a pair of elongated front and rear sealing means 37, 38 are mounted between the opposed front arm projections 28, 29 and between the opposed rear arm projections 30, 31, respectively. The sealing means 37, 38 are carried by the front and rear arm projections 29, 31 on the second member 18, respectively, part of each sealing means being received in one of the recesses 33, 35. The recesses 32, 34 on the first member 17 open toward the recesses 33, 35 on the second member 18, respectively. The sealing means 37, 38 serve as, in addition to the aforementioned purposes, an absorber for dimensional errors of factory-made wall components or panels upon installation.

Also shown in FIG. 2 is a pair of elongated front and rear third members 39, 40. Each of the third members 39, 40 has a generally π-shaped transverse cross section defined by a base 41, 42 covering the joint opening on its one face and a pair of spaced legs 43, 44 and 45, 46 projecting perpendicularly from one side of the base and terminating in inwardly directed snap-locking flanges or lips 47, 47 and 48, 48, respectively. The legs 43, 44 hold the opposed front arm projections 28, 29 and the sealing means 37 therebetween, the snap-locking flanges 47, 47 being in locking engagement with such front arm projections 28, 29 on their respective inner ends, as viewed in transverse cross section. Thus, the front arm projections 28, 29 are secured to each other through the sealing means 37. In the same manner, the rear arm projections 30, 31 are secured to each other through the sealing means 38. The front and rear third members 39, 40 are also made of a relatively rigid but slightly resilient material, such as extruded aluminum. The sealing means 37, 38 are made of a flexible and resilient material, such as rubber, synthetic resin and the like.

For assembly, the first and second members 17, 18 are applied to the two panels 11A, 11B, respectively, the first and second plug projections 19, 20 being fitted in and along the respective panel grooves 13, 14. Then, the first and second members 17, 18 are secured to the respective panels 11A, 11B by the fastening screws 26, 27. The two sealing means 37, 38 are mounted along one of the recesses 33, 35 and one of the recesses 32, 34, respectively, at any time before the panels are positioned edge to edge. Then the panels 11A, 11B, to which the first and second members 17, 18 have been thus attached, respectively, are positioned edge to edge in alignment with each other, and the front and rear third members 39, 40 are applied to the joint opening on and along opposite faces, and moved toward each other with a relatively great force, until the snap-locking flanges 47, 47 and 48, 48 come into locking engagement with the arm projections 28, 29 and 30, 31 on their respective inner ends, as viewed in transverse cross section. Thus, the pair of opposed front arm projections 28, 29 and the sealing means 37 are held together by the front third member 39 between the pair of legs 43, 44; the pair of opposed rear arm projections 30, 31 and the sealing means 38 are held together by the rear third member 40 between the pair of legs 45, 46. As a result, the two panels 11A, 11B are securely connected to each other.

If the panels 11A, 11B thus joined are moved toward each other, with a relatively great force, against resilient forces of the sealing means 37, 38, both front and rear third members 39, 40 can be removed from the first and second members 17, 18 in directions perpendicular to the panel faces, thereby permitting either one or both panels to be removed for replacement.

Figure 3:
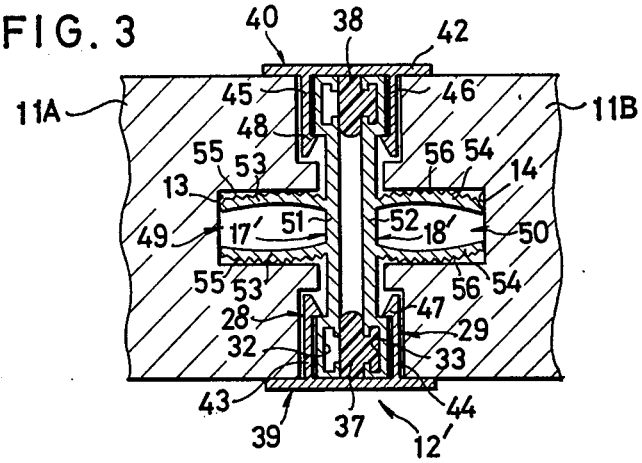
FIG. 3 is a fragmentary cross-sectional view similar to FIG. 2, but showing another embodiment of the connector assembly.

FIG. 3 illustrates a modified connector assembly 12' having a pair of modified first and second members 17', 18', respectively. Other parts of the assembly 12' are the same as those of the assembly 12 and therefore like reference numerals have been used.

The first and second members 17', 18' have a pair of first and second plug means 49, 50. Each of the first and second plug means 49, 50 has a substantially U-shaped transverse cross section defined by a base portion 51, 52 constituting a part of one of the first and second members 17', 18' and a pair of spaced arcuate side walls 53, 53 and 54, 54 projecting substantially perpendicularly from one side of the base portion 51, 52 into one of the panel grooves 13', 14'. Each of such four arcuate side walls 53, 53 and 54, 54 has a corrugation 55, 55 and 56, 56 extending longitudinally on and along its contacting exterior surface, such two pairs of corrugations 55, 55 and 56, 56 engaging interior side walls of the panel grooves 13', 14', respectively, thereby causing the first and second plug means 49, 50 to be firmly fitted in the respective panel grooves 13', 14'. Thus, the two adjacent panels 11C, 11D are secured to each other.

For securing the first and second members 17', 18' to the respective panels 11C, 11D, each of the first and second members 17', 18' is applied to the groove of one of the panels and moved toward the same, in a direction parallel to the panel faces, with a relatively great force, so that each pair of the opposed arcuate side walls 53, 53, and 54, 54 are fitted into one of the panel grooves 13', 14'.

While specific embodiments of the invention have been shown and described in detail to illustrate the application of the principles of the invention, it will be understood that the invention may be embodied otherwise without departing from such principles.

What is claimed is:

1. A connector assembly for connecting two panels edge-to-edge with a joint-opening therebetween, each of the panels having a prefinished groove extending longitudinally along such edge thereof, said connector assembly comprising:

(a) a pair of oppositely disposed, elongated first and second members having first and second plug means adapted to be slidably inserted in and secured to the panels along their respective prefinished panel grooves;

(b) a pair of opposed spaced-apart first and second front arm means adapted to be disposed adjacent to one face of the joint-opening, and carried by said first and second members along their respective front longitudinal edges;

(c) a pair of opposed spaced-apart first and second rear arm means adapted to be disposed adjacent to the opposite face of the joint-opening, and carried by said first and second members along their respective rear longitudinal edges; and (d) a pair of elongated front and rear third members for covering the joint opening on opposite faces, and each having portions for projecting into said joint opening and holding said pair of front arm means and said pair of rear arm means, respectively, whereby said first and second members are secured to each other in spaced-apart relation.

2. A connector assembly according to claim 1, each of said third members having a generally π-shaped transverse cross section defined by a base for covering the joint opening on its one face and a single pair of spaced legs projecting perpendicularly from one side of said base and terminating in inwardly directed snap-locking flanges, said pair of front arm means and said pair of rear arm means being respectively disposed between said pair of legs of one of said third members.

3. A connector assembly according to claim 1, each of said first and second slidably insertable plug means having a substantially U-shaped transverse cross-section defined by a pair of spaced side walls projecting perpendicularly from one side of one of said first and second members and terminating in an end wall extending between said side walls, each of such two end walls having at least one hole through which at least one fastening screw may extend into one of the panels from the bottom of its groove.

4. A connector assembly according to claim 1, each of said first and second slidably insertable plug means including a pair of spaced arcuate walls projecting substantially perpendicularly from one side of one of said first and second members, each of said arcuate walls having a corrugation extending longitudinally on and along its contacting exterior surface for retaining said first and second plug means firmly in the respective panel grooves and engageable directly therewith.

5. A connector assembly according to claim 1, comprising a pair of elastomeric elongated front and rear sealing strips disposed between said pair of front arm means and between said pair of rear arm means, respectively, and carried by one of said pair of front arm means and one of said pair of rear arm means, respectively.

6. A connector assembly according to claim 5, each of said front and rear arm means having a recess opening toward the joint-opening and extending longitudinally on and along one side thereof, each of said sealing strips being retained in one of said recesses.

* * * * *